US005907346A

United States Patent [19]

Yoneda

[11] Patent Number: 5,907,346

[45] Date of Patent: May 25, 1999

[54] METHOD AND APPARATUS FOR THERMAL RECORDING

[75] Inventor: Junichi Yoneda, Shizuoka, Japan

[73] Assignee: Fuji Photo Film Co., Ltd., Kanagawa, Japan

[21] Appl. No.: 08/898,831

[22] Filed: Jul. 23, 1997

[30] Foreign Application Priority Data

Jul. 23, 1996 [JP] Japan ..... 8-193162

[51] Int. Cl.[6] ..... B41J 2/335

[52] U.S. Cl. ..... 347/203

[58] Field of Search ..... 347/200, 203

[56] References Cited

FOREIGN PATENT DOCUMENTS 63-193853 8/1988 Japan ..... B41J 3/20
63-251255 10/1988 Japan ..... B41J 3/20
4-232762 8/1992 Japan ..... B41J 2/335
5-84948 4/1993 Japan ..... B41J 2/335

*Primary Examiner*—Huan Tran
*Attorney, Agent, or Firm*—Sughrue, Mion, Zinn, Macpeak & Seas, PLLC

[57] ABSTRACT

According to the improved method of thermal recording with a thermal head, each time a specified amount of thermal recording has been performed, a coating layer is formed in a specified area of the surface of the protective layer on the glaze of the thermal head and, thereafter, the thermal recording operation is resumed. The improved thermal recording method and the improved thermal recording apparatus to which this method is applied permit a coating layer to be present at all times on the surface of the protective layer on the glaze of a thermal head; hence, a great number of prints can be produced without causing the wear and corrosion of the protective layer, thereby assuring that the thermal head is long-lived to maintain high operational reliability over a prolonged period.

19 Claims, 6 Drawing Sheets

METHOD AND APPARATUS FOR THERMAL RECORDING

BACKGROUND OF THE INVENTION

This invention relates to the art of a method and apparatus for thermal recording using a thermal head.

Thermal recording materials comprising a thermal recording layer on a substrate of a film or the like, which are hereunder referred to as thermal materials, are commonly used to record images produced in diagnosis by ultrasonic scanning.

This recording method, also referred to as thermal recording, eliminates the need for wet processing and offers several advantages including convenience in handling. Hence in recent years, the use of the thermal recording system is not limited to small-scale applications such as diagnosis by ultrasonic scanning and an extension to those areas of medical diagnoses such as CT, MRI and X-ray photography where large and high-quality images are required is under review.

As is well known, thermal recording involves the use of a thermal head having a glaze in which heat-generating elements for heating the thermal recording layer of a thermal material to record an image are arranged in one direction (main scanning direction) and, with the glaze a little pressed against the thermal material (thermal recording layer), the thermal material is relatively moved in the auxiliary scanning direction perpendicular to the main scanning direction, and the heat-generating elements of the respective pixels on the glaze are heated by energy application in accordance with image data to be recorded which were supplied from an image data supply source such as MRI in order to heat the thermal recording layer of the thermal material, thereby accomplishing image reproduction.

The glaze of the thermal head has a protective layer formed on the surface in order to protect the heat-generating elements for heating thermal materials, the associated electrodes and the like. It is this protective layer that contacts the thermal material during thermal recording and the heat-generating elements heat the thermal material through this protective layer so as to perform thermal recording.

The protective layer is usually made of wear-resistant ceramics; however, during thermal recording, the surface of the protective layer is heated and kept in sliding contact with the thermal material, so it will gradually wear and deteriorate upon repeated recording.

If the wear of the protective layer progresses, uneven densities will occur in the thermal image or the desired protective strength can not be maintained and, hence, the ability of the layer to protect the heat-generating elements is impaired to such an extent that the intended image recording is no longer possible (the head has lost its function). Particularly in the application such as the aforementioned medical use which require variable-contrast images of high quality, the trend is toward ensuring the desired high image quality by increasing the settings of recording temperature (energy applied) and of the pressure at which the thermal head is urged against the thermal material, and the protective layer on the thermal head is more prone to deterioration by wear, which largely affects the operational reliability and life of the thermal head.

With a view to preventing the wear of the protective layer on the thermal head, various ideas have been proposed and implemented and they include improvements on the constituent material of the protective layer, its layer arrangement and the recording conditions, as well as methods directed to the formation of a coating layer on the surface of the protective layer.

Among these proposals, the method of forming a coating layer on the surface of the protective layer has been the subject of intensive research and development efforts since it is capable of not only preventing the deterioration by wear of the protective layer but also refilling the pinholes formed in its surface, thereby ensuring that the operational reliability of the thermal head can be greatly improved in comparatively simple ways.

To mention a few examples of the proposals so far made in this direction, they include: Unexamined Published Japanese Patent Application (Kokai) No. 193853/1988 which discloses a thermal head that has an electrically conductive paint applied to the surface of the protective layer to form a coating layer which not only provides improved reliability but also prevents static buildup which would otherwise cause the failure of the heat-generating elements; Kokai No. 251255/1988 which discloses a thermal head that has an anaerobic resin coating formed on the surface of the protective layer to ensure that the pinholes are closed while providing improved reliability; Kokai No. 232762/1992 which discloses a thermal head designed to close the pinholes in the surface of the protective layer while preventing its corrosion by employing a coating agent that has specified values of viscosity, surface tension, softening temperature, thermal decomposition temperature and withstand voltage; and Kokai No. 84948/1993 which discloses a thermal head also designed to close the pinholes in the surface of the protective layer while preventing its corrosion by forming a coating layer made of an alkoxide glass having specified values of viscosity and surface tension.

With these thermal heads having a coating layer formed on the surface of the protective layer, the coating layer can initially attain the intended object by effectively preventing the corrosion and wear so as to ensure the reliability of the thermal heads. On the other hand, these thermal heads heat the thermal recording layer through the coating layer which is kept in sliding contact with the thermal material and, hence, the coating layer will eventually wear upon repeated recording. As a result, in extensively worn areas of the coating layer or in areas where the coating layer has worn out completely, the protective layer is either worn or corroded as in the case of the thermal head having no such coating layer and the reliability and life of the thermal head are inevitably reduced.

SUMMARY OF THE INVENTION

The present invention has been accomplished under these circumstances and has as an object providing a thermal recording method by which the wear and corrosion of the protective layer formed on the glaze of the thermal head can be prevented for a prolonged period, thereby ensuring that the thermal head has an extended life and can operate with high reliability over a prolonged period.

Another object of the invention is to provide a thermal recording apparatus that employs the method.

To achieve the above object, the invention provides a method of thermal recording with a thermal head, in which each time a specified amount of thermal recording has been performed, a coating layer is formed in a specified area of the surface of the protective layer on the glaze of the thermal head and, thereafter, the thermal recording operation is resumed.

It is preferred that said coating layer is formed after cooling the glaze of the thermal head, and that said coating layer is formed by applying a coating agent to the surface of the protective layer on the glaze of the thermal head.

It is also preferred that said coating agent is applied by means of a method of applying a solid type coating agent to the surface of the protective layer on the glaze under pressure as it is moved, a method of spraying a liquid type coating agent, a method of brushing the liquid type coating agent, or a method of dipping in the liquid type coating agent.

It is further preferred that said coating agent is at least one kind selected from the group consisting of polyolefins, vinyl resins, phenolic resins, fluororesins, polyamides, polyimides, polyacetals, acrylic resins, methacrylic resins, polycarbonates, urea resins, polyester resins, urethane resins, alkyd resins, epoxy resins, silicone resins, fibrous substances, starches, proteins, waxes, metal soaps, higher aliphatic acids, higher aliphatic acid amides, and ceramic coating agents.

It is still further preferred that said coating agent is dried after being applied to the surface of the protective layer on the glaze, and that an excess portion of said applied coating agent is removed by wiping or polishing after the coating agent is applied to the surface of the protective layer on the glaze.

Said coating layer has a thickness preferably in the range of from 0.01 to 10 $\mu$m, more preferably from 0.05 to 2 $\mu$m.

Said coating layer is preferably formed once for each performance of thermal recording on thermal materials of B4 size in the range of from 1 sheet to 1,000 sheets, more preferably from 20 sheets to 200 sheets.

Said coating layer is preferably formed once for each performance of thermal recording on thermal materials of B4 size corresponding to a recording length in the range of from 0.36 m to 360 m, more preferably from 7.2 m to 72 m.

Either prior to or after or both before and after the formation of the coating layer, a lapping film or a nonwoven fabric is preferably employed to polish the coating layer or the surface of the protective layer on the glaze of the thermal head.

The invention also provides a thermal recording apparatus which performs image recording by driving a thermal head in accordance with the image data supplied from a source of image data, which includes coating means for forming a coating layer in a specified area of the surface of the protective layer on the glaze of the thermal head each time a specified amount of thermal recording has been performed.

It is preferred that said coating means is at least one of means for moving a coating agent of a solid type along the glaze of the thermal head under pressure, means for spraying a coating agent of a liquid type, means for brushing the liquid type coating agent and means for dipping in the liquid type coating agent.

It is also preferred that said apparatus further comprises means for drying the coating agent applied by the coating means.

It is further preferred that said apparatus further comprises means for removing an excess portion of the applied coating agent by wiping or polishing.

It is still further preferred that said apparatus further comprises means for polishing the coating layer or the surface of the protective layer on the glaze of the thermal head by employing a lapping film or a nonwoven fabric either prior to or after or both before and after the formation of the coating layer.

DETAILED DESCRIPTION OF THE INVENTION

The thermal recording method and apparatus of the invention will now be described in detail with reference to the preferred embodiments shown in the accompanying drawings.

Figure 1:
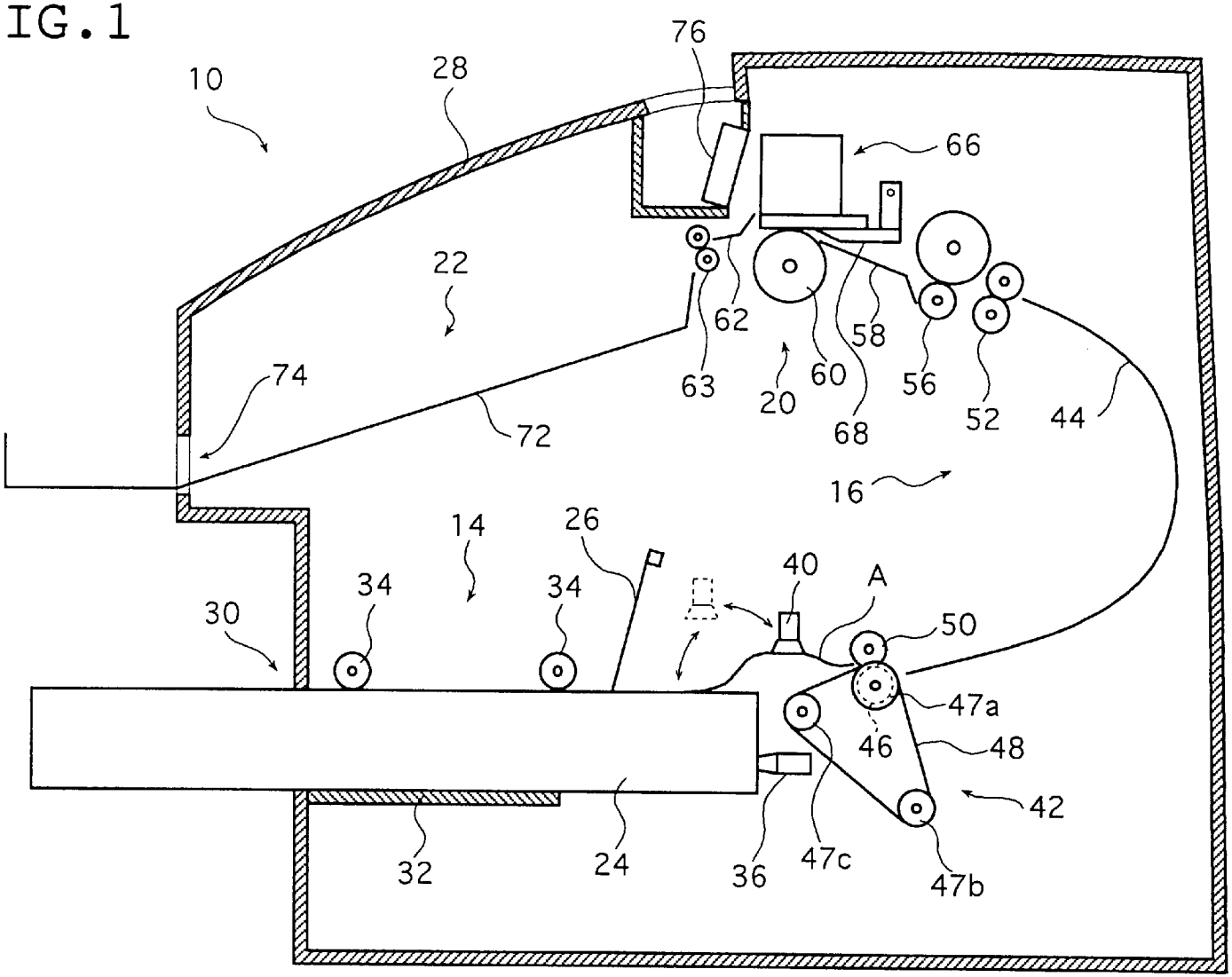
FIG. 1 shows the concept of a thermal recording apparatus according to an embodiment of the invention.

FIG. 1 shows schematically an embodiment of the thermal recording apparatus of the invention using the thermal recording method of the invention.

Figure 2:
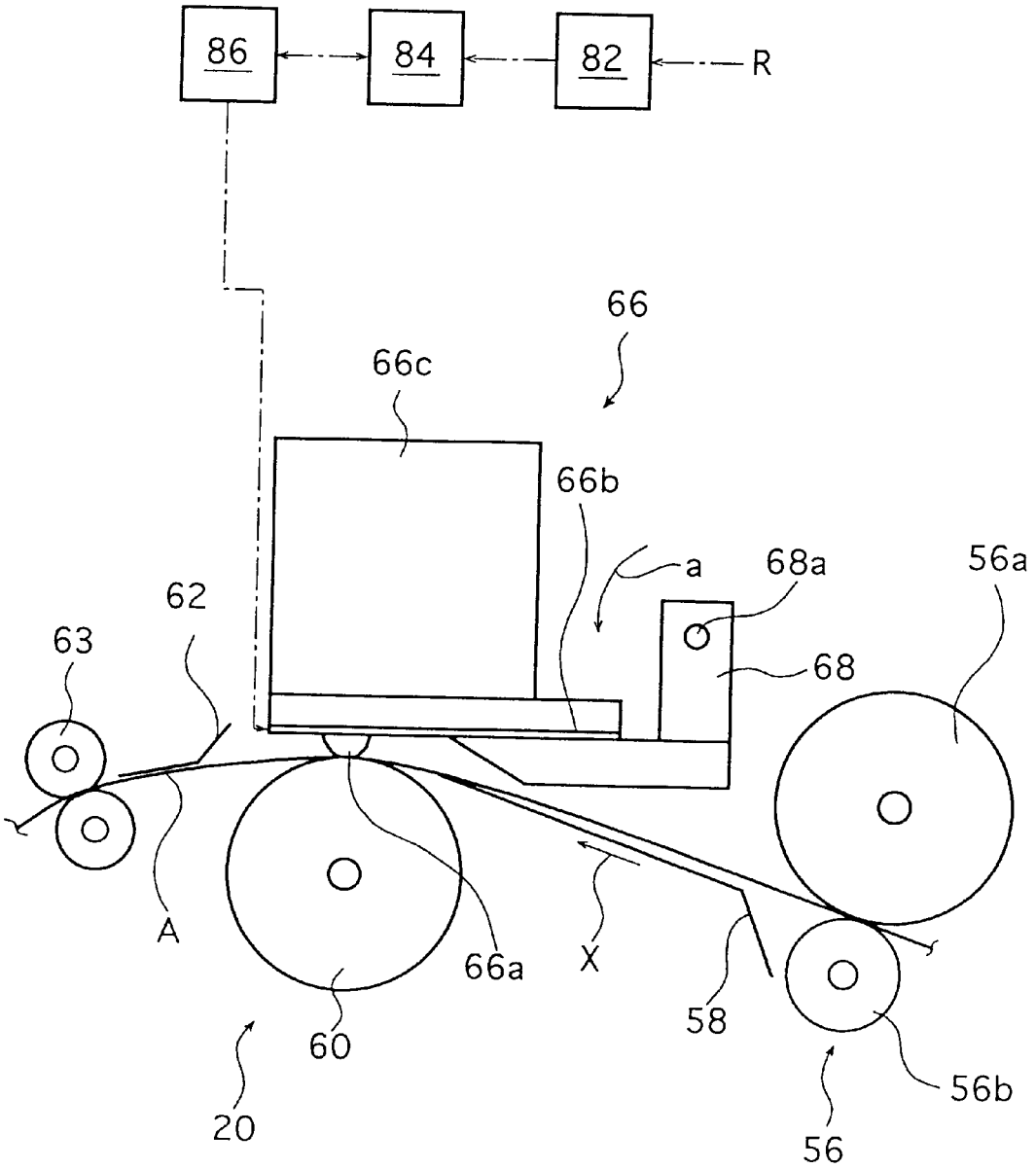
FIG. 2 shows the concept of the recording section of the thermal recording apparatus shown in FIG. 1.

The thermal recording apparatus generally indicated by 10 in FIG. 1 and which is hereunder simply referred to as a "recording apparatus 10" performs thermal recording on thermal recording materials of a given size, say, B4 (namely, thermal recording materials in the form of cut sheets, which are hereunder referred to as "thermal materials A"). The apparatus comprises a loading section 14 where a magazine 24 containing thermal materials A is loaded, a feed/transport section 16, a recording section 20 performing thermal recording on thermal materials A by means of the thermal head 66, and an ejecting section 22. In addition, as shown in FIG. 2, the thermal head 66 is connected to an image processing unit 82, an image memory 84 and a recording control unit 86.

In the thus constructed recording apparatus 10, a thermal material A is taken out of the magazine 24 and transported to the recording section 20, where the thermal material A against which the thermal head 66 is pressed is transported in the auxiliary scanning direction (direction of arrow X in FIG. 2) perpendicular to the main scanning direction in which the glaze extends (normal to the papers of FIGS. 1 and 2) and in the meantime, the individual heat-generating elements are actuated in accordance with image data supplied from an image data supply source R to perform thermal recording on the thermal material A.

The thermal materials A comprise respectively a substrate of a resin film such as a transparent polyethylene terephthalate (PET) film, a paper or the like which is overlaid with a thermal recording layer.

Typically, such thermal materials A are stacked in a specified number, say, 100 to form a bundle, which is either wrapped in a bag or bound with a band to provide a package. As shown, the specified number of thermal materials A bundled together with the thermal recording layer side facing down are accommodated in the magazine 24 of the recording apparatus 10, and they are taken out of the magazine 24 one by one to be used for thermal recording.

The magazine 24 is a case having a cover 26 which can be freely opened. The magazine 24 which contains the thermal materials A is loaded in the loading section 14 of the recording apparatus 10.

The loading section 14 has an inlet 30 formed in the housing 28 of the recording apparatus 10, a guide plate 32, guide rolls 34 and a stop member 36; the magazine 24 is inserted into the recording apparatus 10 via the inlet 30 in such a way that the portion fitted with the cover 26 is inserted first; thereafter, the magazine 24 as it is guided by the guide plate 32 and the guide rolls 34 is pushed until it contacts the stop member 36, whereupon it is loaded at a specified position in the recording apparatus 10.

The loading section 14 is equipped with a mechanism (not shown) for opening or closing the cover 26 of the magazine. Any of the various known mechanisms can be employed to open and close the cover 26.

The feed/transport section 16 has the sheet feeding mechanism using the sucker 40 for grabbing the thermal material A by application of suction, transport means 42, a transport guide 44 and a regulating roller pair 52 located in the outlet of the transport guide 44; thermal materials A are taken one by one out of the magazine 24 in the loading section 14 and transported to the recording section 20.

The transport means 42 is composed of a transport roller 46, a pulley 47*a* coaxial with the roller 46, a pulley 47*b* coupled to a rotating drive source, a tension pulley 47*c*, an endless belt 48 stretched between the three pulleys 47*a*, 47*b* and 47*c*, and a nip roller 50 that pairs with the transport roller 46. The forward end of the thermal material A which has been sheet-fed by means of the sucker 40 is pinched between the transport roller 46 and the nip roller 50 such that the material A is transported.

When a signal for the start of recording is issued, the cover 26 is opened by the OPEN/CLOSE mechanism in the recording apparatus 10. Then, the sheet feeding mechanism using the sucker 40 picks up one sheet of thermal material A from the magazine 24 and feeds the forward end of the sheet to the transport means 42 (to the nip between rollers 46 and 50). At the point of time when the thermal material A has been pinched between the transport roller 46 and the nip roller 50, the sucker 40 releases the material, and the thus fed thermal material A is supplied by the transport means 42 into the regulating roller pair 52 as it is guided by the transport guide 44. At the point of time when the thermal material A to be used in recording has been completely ejected from the magazine 24, the OPEN/CLOSE mechanism closes the cover 26.

The distance between the transport means 42 and the regulating roller pair 52 which is defined by the transport guide 44 is set to be somewhat shorter than the length of the thermal material A in the direction of its transport. The advancing end of the thermal material A first reaches the regulating roller pair 52 by the transport means 42. The regulating roller pair 52 are normally at rest. The advancing end of the thermal material A stops here and is subjected to positioning.

When the advancing end of the thermal material A reaches the regulating roller pair 52, the temperature of the thermal head 66 (glaze 66*a*) is checked and if it is at a specified level, the regulating roller pair 52 start to transport the thermal material A, which is transported to the recording section 20.

FIG. 2 shows schematically the recording section 20.

The recording section 20 has the thermal head 66, a platen roller 60, a cleaning roller pair 56, a guide 58, a fan 76 for cooling the thermal head 66 (see FIG. 1) and a guide 62. The thermal head 66 (the thermal head body 66*b*) is connected to the image processing unit 82, the image memory 84 and the recording control unit 86 constituting a recording control system.

The thermal head 66 is capable of thermal recording at a recording (pixel) density of, say, about 300 dpi on thermal films for example up to a maximum of B4 size. The head comprises a body 66*b* having the glaze 66*a* in which the heat-generating elements performing thermal recording on the thermal material A are arranged in one direction, that is in the main scanning direction, and a heat sink 66*c* fixed to the body 66*b*. The thermal head 66 is supported on a support member 68 that can pivot about a fulcrum 68*a* either in the direction of arrow a or in the reverse direction.

The glaze 66*a* has on the surface thereof a protective layer made of wear-resistant ceramics, which is coated with a coating layer as described below.

The platen roller 60 rotates at a specified image recording speed while holding the thermal material A in a specified position, and transports the thermal material A in the auxiliary scanning direction (direction of arrow in FIG. 2) perpendicular to the main scanning direction.

The cleaning roller pair 56 consists of an adhesive rubber roller 56*a* made of an elastic material and a non-adhesive roller 56*b*. The adhesive rubber roller 56*a* picks up dirt and other foreign matter that has been deposited on the thermal recording layer in the thermal material A, thereby preventing the dirt from being deposited on the glaze 66*a* or otherwise adversely affecting the image recording operation.

Before the thermal material A is transported to the recording section 20, the support member 68 in the illustrated recording apparatus 10 has pivoted to UP position (in the direction opposite to the direction of arrow) so that the thermal head 66 (or glaze 66*a*) is in the standby position just before coming into contact with the platen roller 60.

When the transport of the thermal material A by the regulating roller pair 52 starts, said material is subsequently pinched between the cleaning roller pair 56 and transported as it is guided by the guide 58. When the advancing end of the thermal material A has reached the record START position (i.e., corresponding to the glaze 66*a*), the support member 68 pivots in the direction of arrow a and the thermal material A becomes pinched between the glaze 66*a* on the thermal head 66 and the platen roller 60 such that the glaze 66*a* is pressed onto the recording layer while the thermal material A is transported in the direction indicated by arrow X by means of the platen roller 60 (as well as the regulating roller pair 52 and the transport roller pair 63) as it is held in a specified position by the platen roller 60.

During this transport, the heat-generating elements of the respective pixels on the glaze 66*a* are actuated imagewise to perform thermal recording on the thermal material A.

Image data from an image data supply source R such as CT or MRI is sent to the image processing unit 82.

The image processing unit 82 receives image data from the image data supply source R, performs as required formatting (i.e., enlargement or reduction and frame assignment), and performs specified image processing jobs, such as sharpness compensation for edge enhancement, tone correction for producing an appropriate image in accordance with the gamma value and other characteristics of the thermal material A, temperature compensation for adjusting the energy of heat generation in accordance with the temperature of heat-generating elements of each pixel, shading compensation for correcting the uneven density caused by the shape variability and other factors of the glaze 66*a*, resistance compensation for correcting the difference between the resistances of heat-generating elements of each pixel, and black ratio compensation for color development at a density in accordance with the image data in spite of the variation in the drop of supply voltage to the thermal head due to the change in the pattern to be recorded; whereupon the data for the image to be thermally recorded by means of the thermal head 66 is delivered as an output to the image memory 84.

Image data for thermal recording which were delivered from the image processing unit 82 are sent to the image memory 84 and stored.

The recording control unit 86 reads the stored image data for thermal recording sequentially out of the image memory 84 line by line in the main scanning direction. The control unit 86 then supplies the thermal head 66 with recording data representing the thus read image data for thermal recording (and represented by the duration of time for which voltage is applied in accordance with the output image density).

The individual heat-generating elements on the thermal head 66 generate heat in accordance with the received recording data and, as already described above, thermal image recording is performed on the thermal material A as it is transported in the direction of arrow X by such means of transport as the platen roller 60.

After the end of thermal recording, the thermal material A as it is guided by the guide 62 is transported by the platen roller 60 and a transport roller pair 63 to be ejected into a tray 72 in the ejecting section 22. The tray 72 projects exterior to the recording apparatus 10 via the outlet 74 formed in the housing 28 and the thermal material A carrying the recorded image is ejected via the outlet 74 for takeout by the operator.

The thermal recording apparatus 10 of the invention has coating means 80 which is designed to form a coating layer on the surface of the protective layer on the glaze 66*a* each time after thermal recording has been done on a specified amount of the thermal material A. Having this design, the thermal recording apparatus 10 ensures that the coating layer is always present on the surface of the protective layer on the glaze 66*a* of the thermal head 66 in order to prevent the wear and corrosion of the protective layer, whereby the thermal head 66 is long-lived and maintains high operational reliability over an extended period.

Figure 3:
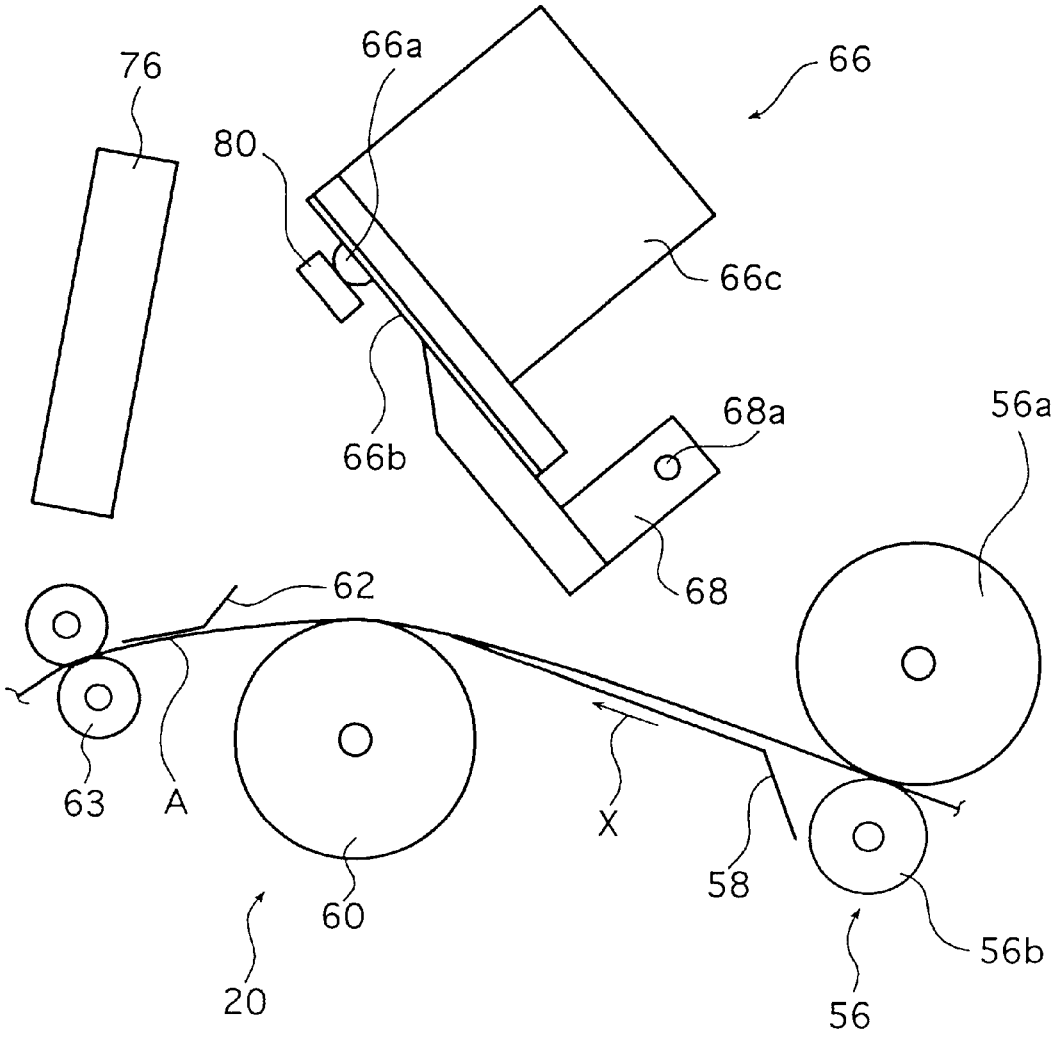
FIG. 3 is a conceptual diagram illustrating how a coating layer is formed in the thermal recording apparatus shown in FIG. 1.

If thermal recording has been done on a specified amount of the thermal material A, say, 100 sheets of it, the recording apparatus 10 discontinues its operation and causes the support member 68 to pivot about the fulcrum 68*a* in a direction opposite to arrow a as shown in FIG. 3, whereupon the glaze 66*a* of the thermal head 66 is moved to a predetermined coating layer forming position; in addition, the recording apparatus 10 causes the coating means 80 to be moved to a position in registry with the glaze 66*a*.

The coating means 80 may be moved by any known means such as a link mechanism and the selection of a suitable means depends on the internal configuration of the recording apparatus 10, the shape and size of the coating means 80, etc.

In the next step, the coating means 80 applies a coating agent to the glaze 66*a*. Depending on the need, the coating step may be performed after cooling the glaze 66*a*. It is optional to use a cooling fan 76 for accelerating the cooling speed.

The coating method is not limited in particular way and may be selected as appropriate for the specific type of the coating agent to be used. If the coating agent is of a solid type such as solid wax, it may be applied to the glaze 66*a* under pressure as it is moved in the main scanning direction (normal to the paper of FIG. 3). If the coating agent is of a liquid type, it may be applied by various known methods including spraying, brushing and dipping. Solid coating agents may be dissolved or dispersed in water, organic solvents, etc. to prepare liquid forms which can be applied by spraying, brushing, etc.

There are also no limitations on the method of moving the coating means 80 and any known methods including screw driving, wrapping connector driving and a rack-and-pinion adjustment may be employed.

Figure 3A:
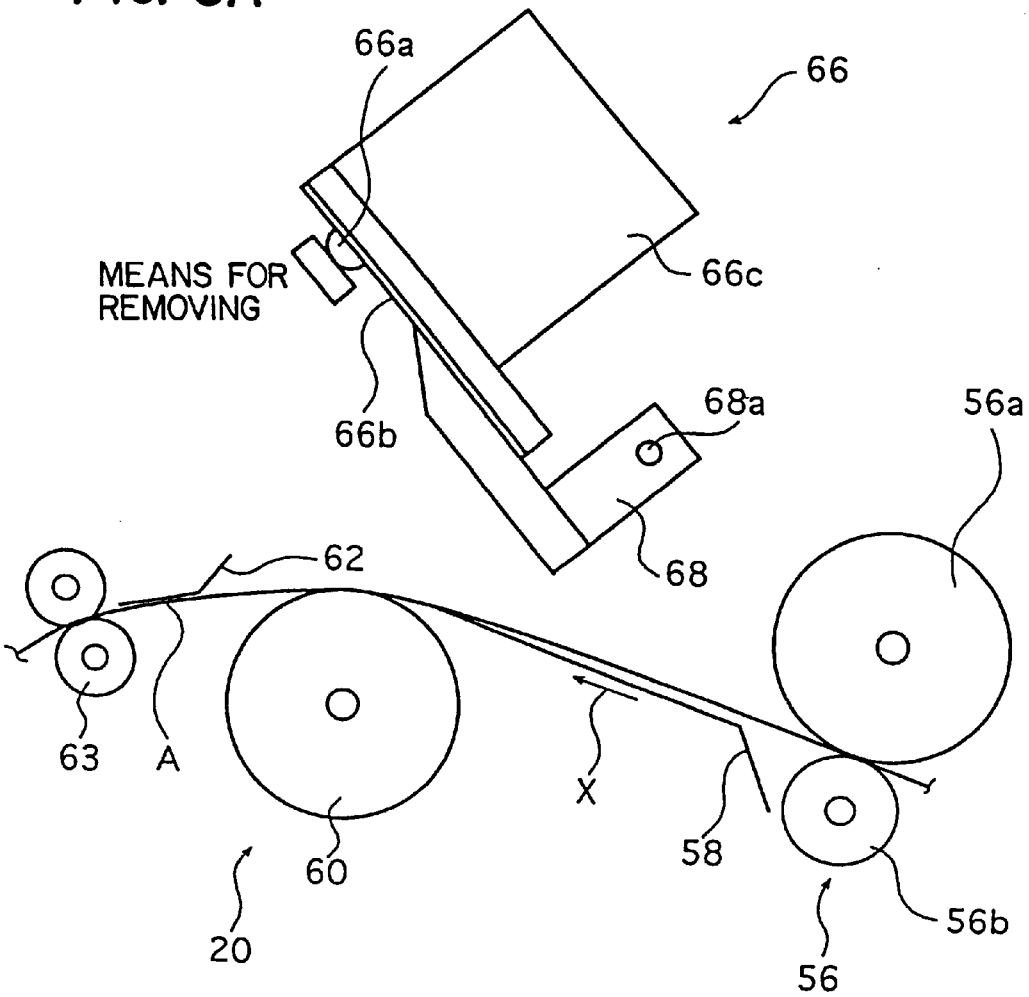
FIG. 3A is a diagrammatic showing of the present invention including a means for removing an excess portion of an applied coating agent.

The applied coating agent may optionally be dried or any excess portion of it may optionally be removed by wiping or polishing (see FIG. 3A). Thereafter, the coating means 80 is replaced in the initial position and the support member 68 is pivoted in the direction of arrow such that the thermal head 66 is moved to the aforementioned standby position. Subsequently, the thermal recording operation restarts, waiting for the thermal material A to be transported to the recording position.

Figure 3B:
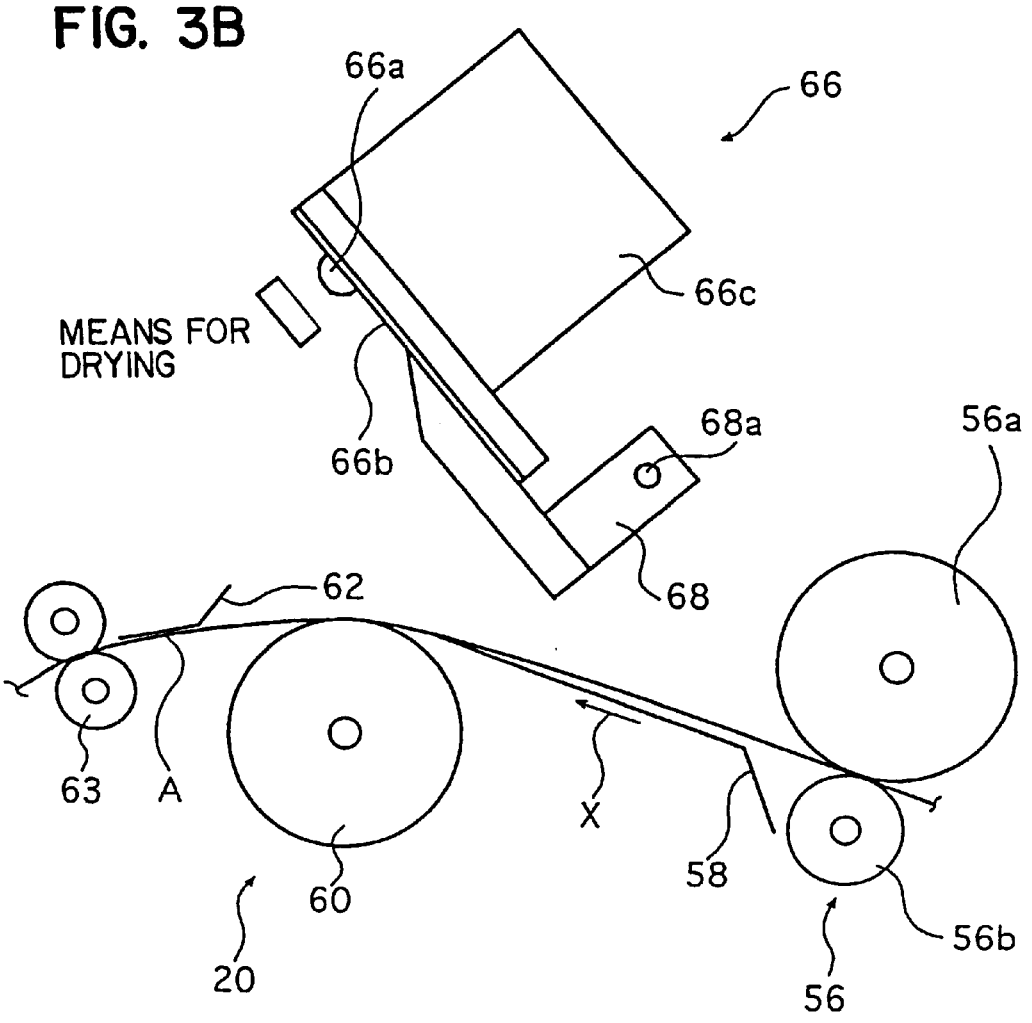
FIG. 3B is a diagrammatic showing of the present invention including a means for drying an applied coating agent.

If desired, the drying of the applied coating agent may be accelerated by a suitable method such as air drying with a cooling fan 76, heating of the glaze 66*a* or drying with a separately provided drying means (see FIG.3B). Wiping of the excess coating agent may be accomplished by the coating means 80 per se or by a separately provided wiping means.

There are no particular limitations on the coating agent that can be used and various known coating agents conventionally used in coating the protective layer on the thermal head may be employed in the invention.

Specific examples include: various resins such as polyolefins (polyethylene, polypropylene and polystyrene), vinyl resins (e.g. polyvinyl chloride, polyvinyl alcohol and carboxy-modified polyvinyl alcohol), phenolic resins, fluororesins, polyamides, polyimides, polyacetals, (meth) acrylic resins, polycarbonates, urea resins, saturated or unsaturated polyesters, urethane resins, alkyd resins, epoxy resins, and silicone resins; various fibrous substances such as methyl cellulose, carboxymethyl cellulose and hydroxyethyl cellulose; starches and proteins such as gelatin; various waxes such as paraffin wax, microcrystalline wax, candelilla wax, carnauba wax, rice wax, lanolin and montan wax; metal soaps such as zinc stearate and calcium stearate; higher aliphatic acids, higher aliphatic acid amides, and ceramic coating agents which are based on ceramics such as silica and alumina.

These coating agents may be admixed or they may optionally be combined with various additives such as fillers (e.g. pigments) and surfactants. If desired, the coating agent may be diluted with a solvent or water to have its viscosity adjusted to a value suitable for the coating procedure and/or post-coating wiping, polishing, etc. may be performed in order to provide a coating layer of an appropriate thickness, which is preferably about 0.01–10 $\mu$m, more preferably about 0.05–2 $\mu$m.

In the present invention, the coating layer is re-formed each time a specified amount of thermal recording has been effected, for example, on a specified number of sheets of the thermal material or for specified distance (in terms of the recording length in the direction of transport of the thermal material). The re-forming interval is not limited in any particular way and may be determined as appropriate for the wear and corrosion resistance of the coating layer to be formed; to take a thermal material of B4 size as an example, the coating layer is usually reformed once for each performance of thermal recording on one sheet of the thermal material (corresponding to a recording length of 0.36 m) to 1,000 sheets (360 m), preferably in the range from 20 sheets (7.2 m) to 200 sheets (72 m). Alternatively, the coating layer may be re-formed at any time such as the one considered to be appropriate by the operator. Needless to say, the re-forming interval may be altered or adjusted as appropriate for various factors such as the changes in the recording conditions, the image pattern to be chiefly recorded and the environment in which the recording apparatus is to be installed, as well as the total operating time of the apparatus, the extent of its deterioration, and the thermal material to be employed.

If liquid waxes and the like are to be used as the coating agent, the frequency of re-forming the coating layer is preferably increased.

Figure 3C:
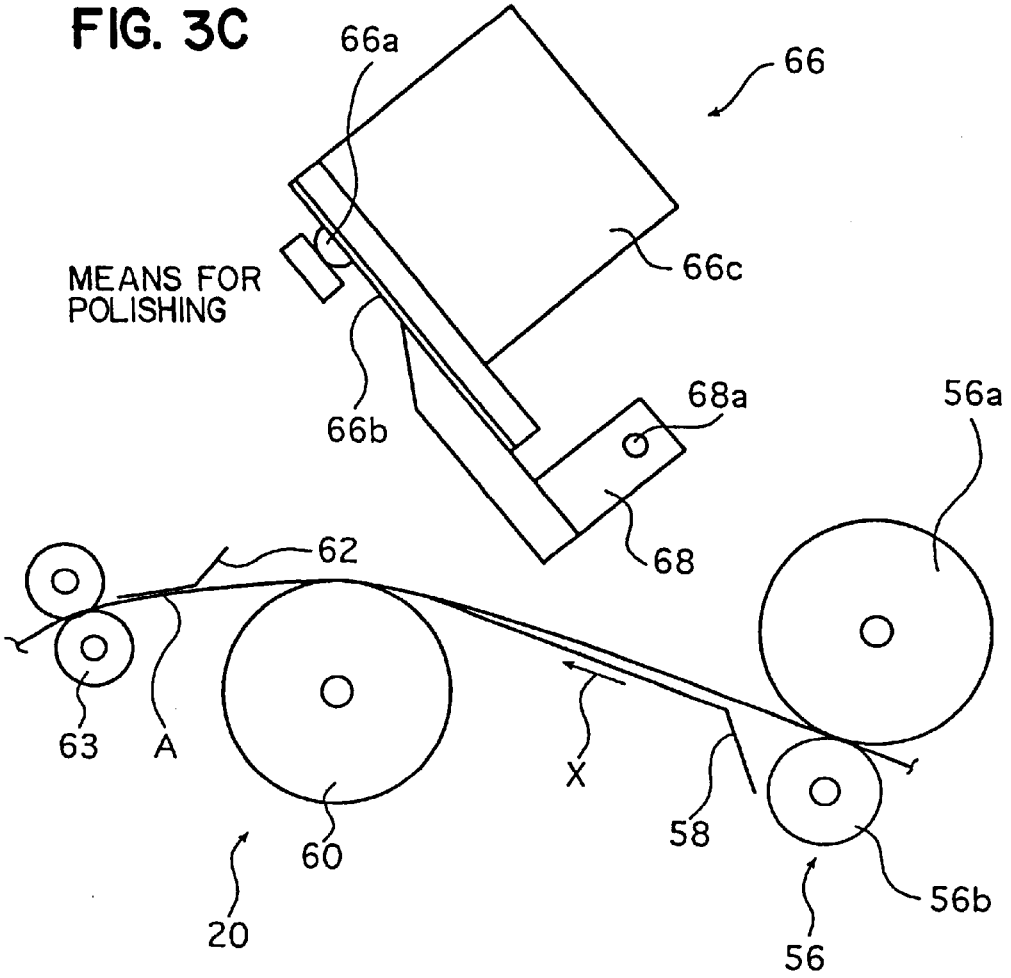
FIG. 3C is a diagrammatic showing of the present invention including a means for polishing a coating layer and a protective layer.

It is also within the scope of the invention that either prior to or after the re-formation of the coating layer or both before and after its re-formation, a lapping film, a nonwoven fabric or like means may optionally be employed to polish the coating layer or the surface of the protective layer such as to prevent the uneven application of the coating layer and, hence, the deterioration in image quality which would otherwise occur if it were not applied uniformly (see FIG. 3C).

The recording apparatus 10 in the embodiment described above has the coating means 80 and the necessary components to ensure that the coating layer is automatically re-formed when a specified amount of thermal recording has been done; however, that is not the sole case of the invention and the re-forming operation may be performed manually by the operator. In this alternative case, the coating method, the coating agent and other conditions that are described for the automatic coating operation are applicable without any changes, except that the apparatus may be adapted to be such that each time a specified amount of thermal recording has been done, the operator is informed of the need to re-form the coating layer by various signal means such as a display appearing on the operating panel, an audible alarm sound or a lamp turned on.

On the foregoing pages, the thermal recording method and apparatus of the invention have been described in detail but the present invention is in no way limited to the stated embodiments and various improvements and modifications can of course be made without departing from the spirit and scope of the invention.

As described above in detail, the thermal recording method and apparatus of the invention permit a coating layer to be present at all times on the surface of the protective layer on the glaze of a thermal head; hence, a great number of prints can be produced without causing the wear and corrosion of the protective layer, thereby assuring that the thermal head is long-lived to maintain high operational reliability over a prolonged period.

EXAMPLES

The following specific example of the invention is provided to give a further illustration of it.

A protective layer on a thermal head (KGT-260-12MPH8 of KYOCERA CORP.) was coated with a wax (Blue Coral Super Barrier of Blue Coral International Ltd.), dried and polished with a nonwoven cloth to form a coating layer.

Using the thermal head having this coating layer, thermal recording was effected on a thermal film (DI-AT film of Fuji Photo Film Co., Ltd.; B4 size). Re-formation of the coating layer was repeated upon each recording of 100 prints. After thermal recording of 1,300 prints, the wear of the protective layer on the thermal head was measured.

In a comparative run, the same coating layer was formed on the protective layer but not re-formed during the thermal recording of 1,300 prints from the same thermal material. The wear of the protective layer on the thermal head was also measured.

In the comparative run in which formation of the coating layer was not repeated, the protective layer wore about 1.8 μm but in the example of the invention in which re-waxing was performed upon each recording of 100 prints, the wear of the protective layer was substantially zero.

In other words, the protective layer which was waxed to form the coating layer only once prior to the thermal recording operation wore about 1.8 μm; however, by repeating re-formation of the coating layer, its effectiveness could be maintained satisfactorily to prevent the wear of the protective layer.

These results clearly demonstrate the effectiveness of the present invention.

What is claimed is:

1. A method of thermal recording with a thermal head having a glaze with a protective layer, comprising the steps of:

performing thermal recording; and forming a coating layer on the protective layer each time a specified amount of thermal recording is performed.

2. A method according to claim 1, comprising the step of cooling the glaze before said step of forming the coating layer.

3. A method according to claim 1, wherein said step of forming the coating layer includes the step of applying a coating agent to the protective layer.

4. A method according to claim 3, wherein said step of applying the coating agent includes one of the steps of applying a solid type coating agent under pressure as the solid type coating agent is moved, spraying a liquid type coating agent, brushing a liquid type coating agent, and dipping the glaze in a liquid type coating agent.

5. A method according to claim 3, wherein said coating agent is at least one substance selected from the group consisting of polyolefins, vinyl resins, phenolic resins, fluororesins, polyamides, polyimides, polyacetals, acrylic resins, methacrylic resins, polycarbonates, urea resins, polyester resins, urethane resins, alkyd resins, epoxy resins, silicone resins, fibrous substances, starches, proteins, waxes, metal soaps, higher aliphatic acids, higher aliphatic acid amides, and ceramic coating agents.

6. A method according to claim 3, wherein said step of forming the coating layer includes drying the applied coating agent.

7. A method according to claim 3, wherein said step of forming the coating layer includes removing an excess portion of the applied coating agent wiping and polishing the protective layer.

8. A method according to claim 1, wherein said coating layer has a thickness in the range of from 0.01 to 10 μm.

9. A method to claim 1, wherein said coating layer has a thickness in the range of from 0.05 to 2 μm.

10. A method according to claim 1, wherein said step of forming the coating layer is performed after thermal recording on a predetermined number of sheets of thermal material of B4 size, said predetermined number being in the range of 1 to 1,000.

11. A method according to claim 1, wherein said step of forming the coating layer is performed after thermal recording on a predetermined number of sheets of thermal material of B4 size, said predetermined number being in the range of 20 to 200.

12. A method according to claim 1, wherein said step of forming the coating layer is performed after thermal recording on thermal material of B4 size corresponding to a recording length in the range of 0.36 m to 360 m.

13. A method according to claim 1, wherein said step of forming the coating layer is performed after thermal recording on thermal material of B4 size corresponding to a recording length in the range of 7.2 m to 72 m.

14. A method according to claim 1, prior to or after or both before and after the formation of the comprising the step of using one of a lapping film and a nonwoven fabric to polish at least one of the coating layer, and the protective layer before the step of forming the coating layer.

15. A thermal recording apparatus which performs image recording by driving a thermal head in accordance with image data supplied from a source of the image data, comprising:

a glaze having a Protective layer disposed thereon; and coating means for forming a coating layer on the protective layer each time a specified amount of thermal recording has been performed.

16. An apparatus according to claim 15, wherein said coating means includes at least one of means for moving a solid tyoe coating agent along the protective layer under pressure, means for spraying a liquid type coating agent, means for brushing a liquid type coating agent and means for dipping the glaze in a liquid type coating agent.

17. An apparatus according to claim 16, comprising means for drying the coating agent applied by the coating means.

18. An apparatus according to claim 16, comprising means for removing an excess portion of the applied coating agent by wiping or polishing.

19. An apparatus according to claim 15, comprising means for polishing at least one of the coating layer and the protective layer before the formation of the coating layer with one of a lapping film and a nonwoven fabric.

* * * * *